US005207401A

United States Patent [19]

Testart

[11] Patent Number: 5,207,401

[45] Date of Patent: May 4, 1993

[54] SWITCH FOR A GROOVED GUIDE TRACK

[75] Inventor: Gérard F. Testart, Niederbronn-les-Bains, France

[73] Assignee: Cogifer-Compagnie Generale d'Installations Ferroviaires, Croicssy-Sur-Seine, France

[21] Appl. No.: 704,968

[22] Filed: May 23, 1991

[30] Foreign Application Priority Data

May 23, 1990 [FR] France ..... 90 06463

[51] Int. Cl.[5] ..... E01B 7/02

[52] U.S. Cl. ..... 246/442; 246/435 R

[58] Field of Search ..... 104/195, 130; 246/267, 246/415 R, 419, 435 R, 442, 453

[56] References Cited

U.S. PATENT DOCUMENTS

| | | | |
|---|---|---|---|
| 795,232 | 7/1905 | Pflieger | 104/195 |
| 816,308 | 3/1906 | Farmer | 246/419 |
| 816,646 | 4/1906 | Connett | 104/195 |
| 820,406 | 5/1906 | Flogan, Sr. | 246/385 |
| 915,857 | 3/1909 | Healy | 246/267 |
| 1,009,149 | 11/1911 | Johnson | 246/267 |
| 1,721,460 | 7/1929 | Mariman | 246/435 R |
| 1,788,622 | 1/1931 | Gillispie . | |
| 3,019,741 | 2/1962 | Bishop et al. | 246/442 X |
| 4,032,095 | 6/1977 | Ferbeck et al. | 246/435 R X |
| 4,924,776 | 5/1990 | Uttscheid | 104/195 X |
| 4,953,814 | 9/1990 | Oswald et al. | 246/385 X |

FOREIGN PATENT DOCUMENTS

| | | | |
|---|---|---|---|
| 330238 | 8/1989 | European Pat. Off. | 246/435 R |
| 23508 | 8/1883 | Fed. Rep. of Germany . | |
| 445545 | 6/1912 | France . | |
| 2307689 | 11/1976 | France . | |

*Primary Examiner*—Frank E. Werner
*Assistant Examiner*—Scott L. Lowe
*Attorney, Agent, or Firm*—Wenderoth, Lind & Ponack

[57] ABSTRACT

A switch includes a frame constituted, inter alia, by a single point end plate, preferably mechanically welded, for supporting stock rails at ends thereof adjacent a principle route, and by a double heel end plate, preferably mechanically welded, for supporting heel ends of each of two stock rail/switchblade pairs adjacent a direct route and a deviated route. Spacers maintain distance between the stock rails adjacent the principal route and the stock rail/switchblade heel pairs adjacent the direct and deviated route. Sole plates support the stock rails and/or switchblades. Inner stops are placed between the switchblades in the vicinity of their heel ends and are carried by the sole plates. Outer stops are placed between the stock rails and the switchblades in the vicinity of their point ends and are carried by the stock rails.

23 Claims, 5 Drawing Sheets

SWITCH FOR A GROOVED GUIDE TRACK

BACKGROUND OF THE INVENTION

The present invention relates to a track apparatus for guided vehicles, and more especially for vehicles guided by means of a grooved guide track which is separate from the runway on which circulate wheels providing the vertical support of the vehicle.

More particularly, the invention relates to a switch for a grooved guide track, which is constituted by a switch frame formed from two fixed stock rails and from two partially movable switchblades.

Transport vehicles which move along runways on which circulate wheels supporting the vehicle, the guiding of which vehicle being provided by rollers which follow a grooved guide track, are known. For this type of vehicle, conventional switches used for conventional rail transport means cannot be used as such. Indeed, that would require moving weighty and bulky components which would take a relatively long time to maneuver and would require considerable effort.

One type of solution for a switch for a grooved guide track is, for example, described in French Patent 2,307,689. The switch described in this document is constituted, essentially, by a fixed subassembly, confronting inner vertical faces of which constitute outer faces of the guide grooves, and by a movable subassembly which is maneuverable in the manner of the switchblades of a traditional switch, the opposite outer vertical faces of which serve as inner faces for the guide grooves which orient, in one direction or another, a guide roller independently of any action on wheels serving for the support of the vehicle. As is explained in this document, the fixed subassembly is constituted by a single entity made of steel cast en bloc, comprising in itself parts serving for the sliding support of the movable subassembly and parts serving for the embedding of the movable subassembly, and also parts permitting the fixing of control, interlocking and immobilization systems of the movable subassembly in each of the positions that it may take.

In order to obtain complex components cast directly en bloc, molds need to be manufactured beforehand and must, of course, be adapted to each type of apparatus which it is necessary to manufacture. It is therefore necessary to have a collection of molds available so as to obtain right-hand deviations and left-hand deviations, for example.

In addition to the fact that it is necessary to have a large collection of molds available, the manufacturing cycle of molded articles is particularly long and delicate.

It will be understood therefore that although this solution is generally technically satisfactory, it is costly, laborious and difficult to implement

SUMMARY OF THE INVENTION

The object of the invention is to overcome the majority of the drawbacks which have been mentioned briefly above by the implementation of a manufacturing technique of mechanical assembly or mechanical welding which makes it possible to obtain switches of different types for a grooved guide track in a rapid manner and with a very small number of elementary constituents.

The subject of the invention is a switch for a grooved guide track constituted by two lateral rails each preferably having a foot, a web and a head, between facing and spaced apart flanks of which there may freely circulate a roller mounted on a vehicle to be directed by this track, in which arrangement this switch intended to be carried by sleepers or the like includes two fixed stock rails and two partially movable switchblades which each have a point or point end and a heel or heel end and which are arranged between these stock rails in such a manner that their heels are immobilized and their points may be displaced simultaneously by flexion of the switchblades in order that, alternately, one or the other of the latter is applied against one or the other of the stock rails so as, starting from a principle route, to give access to a direct route or to a deviated route. The switch according to the invention also includes a frame constituted, inter alia, by a single point end plate, mechanically assembled or mechanically welded, for supporting the stock rails at ends thereof adjacent the principle route, by a double heel end plate, mechanically assembled or mechanically welded, for supporting heel ends of two stock rail/switchblade pairs adjacent both the direct and deviated routes, by spacers for maintaining a distance between the stock rails of the principal route and the stock rail/switchblade heel pairs of each of the direct and deviated routes, by sole plates for supporting the stock rails and/or switchblades, by inner stops placed between the switchblades in the vicinity of their heel ends and carried by sole plates, and by outer stops placed between the stock rails and switchblades in the vicinity of their point ends and carried by the stock rails.

BRIEF DESCRIPTION OF THE DRAWINGS

Other features of the invention will emerge on reading the specification and claims which follow and from examining the attached drawing, given merely by way of example, in which:

DETAILED DESCRIPTION OF THE INVENTION

Figure 1:
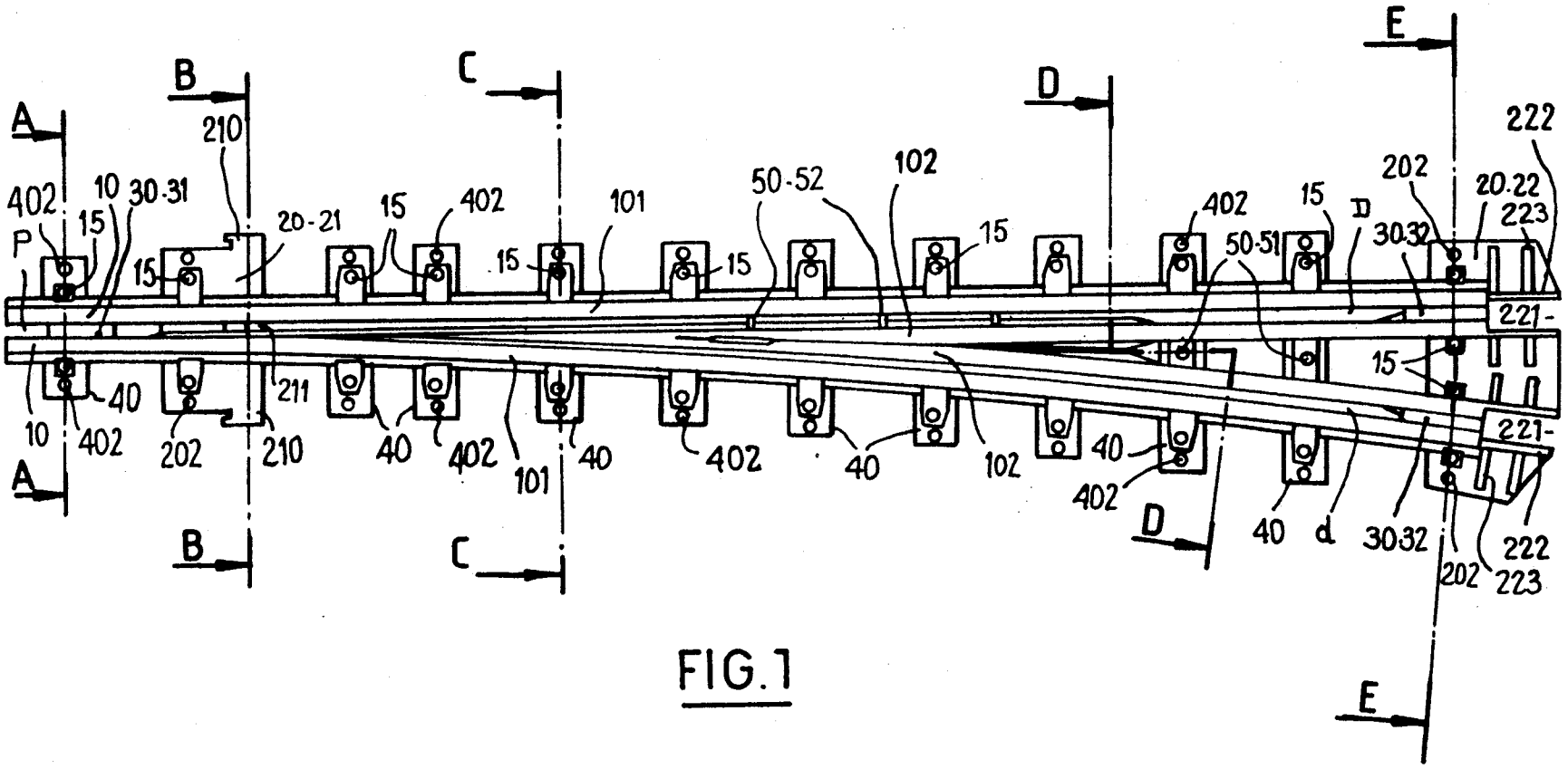
FIG. 1 is a diagrammatic plan view of a switch according to the invention.

Track apparatuses and, in particular, switches, be they for traditional railway tracks or for grooved guide tracks, are well known in the art. For this reason, the following will only describe what is of direct or indirect concern to the invention. For the rest, the specialist of the art in question will exploit the current conventional solutions available to him in order to confront the specific problems with which he is faced.

In the specification which follows, an identical reference numeral always designates a single and identical homologous element, irrespective of the embodiment.

Vehicles which circulate on a runway which supports support wheels and the direction of which is provided by lateral guide tracks are well known.

The subject of the invention is a track apparatus and, more particularly, a switch which makes it possible to direct and to change the direction followed by a vehicle which moves on a "proper" track or on a track for two-way working or operation by means of wheels which provide support of the vehicle by circulating on runways and the guiding of which is provided, for example, by means of at least one roller being displaced in a groove when changing tracks. As is known, this type of solution is compatible with the traditional solutions for two-way working, and permits the level passage of vehicles such as cars or lorries. The word "proper" here has its specific meaning associated with the transport means.

For the sake of convenience of description, each of the constituents of the invention, or which cooperate with the latter, will be described successively.

A grooved guide track is, for example, constituted by two lateral rails 10 each having a foot 11, a web 12 and a head 13. These heads possess flanks 130 of which those facing one another are maintained spaced apart at a distance and between which there may freely circulate at least one guide roller G of a vehicle V on which it is mounted so as to direct it along this track. It is these two flanks which delimit a groove 0.

The object of the switch according to the invention is to make it possible for the vehicle V which follows a principle route P to be able to be directed either on a direct route D or on a deviated route d. As can be seen in the embodiment of FIG. 1, the deviated route d is a curved track directed towards the right. It is obvious that, with the necessary transpositions, this curved deviated route could also be directed towards the left.

The switch according to the invention is intended to be carried for example by means of sleepers, longitudinal sleepers, slabs or any appropriate suitable supports (not shown) on which it is maintained by current fixing means (not shown), such as coach screws. In order to mount the switch according to the invention, assembly means 15 are used which comprise, for example, bolts 151 or nuts and bolts and clips, braces 152 or the like, as is conventional.

This switch includes two stock rails 101, which are fixed, and two switchblades 102, which are partially movable, and which each have a point or point end and a heel or heel end and which are arranged between stock rails 101 in such a manner that the heels are immobilized by embedding or mounting and the points may be displaced simultaneously together by flexion of the switchblades which behave in the manner of a beam which is fixed or embedded at one of its ends. A control, interlocking and immobilization system 17 makes it possible, alternately, to place one or the other of the switchblades 102 against one or the other of the stock rails 101 in order, starting from the principle route P, to give access to the direct route D or to the deviated route d. The control, interlocking and immobilization system 17, which may be motorized or manual, is of any known type. It comprises, for example, an operating rod 171 terminated by an engagement lug 172 which grips round the point of at least one of the switchblades so as to maneuver them.

As can be seen by examining the various figures of the drawings, the switch according to the invention also includes a frame constituted, inter alia, by end plates 20, spacers 30, sole plates 40 and stops 50.

Figure 2A:
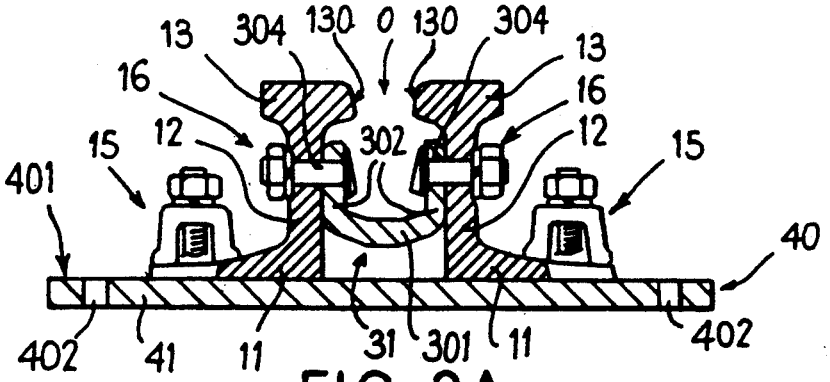
FIGS. 2A, 2B, 2C, 2D and 2E are sectional views along planes A, B, C, D and E, respectively, of FIG. 1.
Figure 2B:
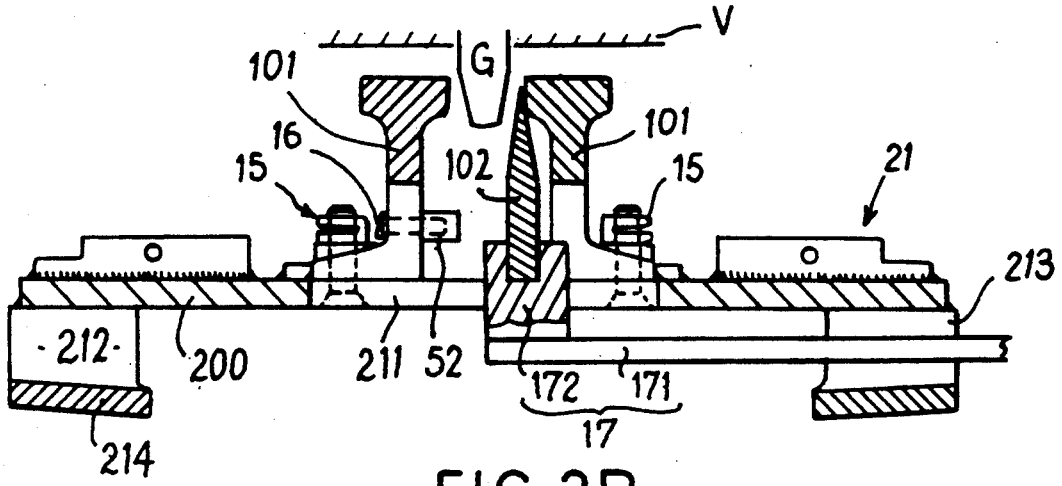
Figure 2C:
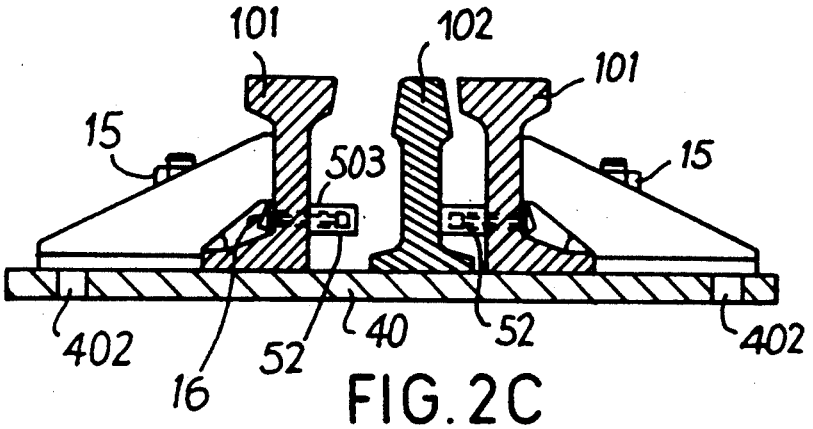
Figure 2D:
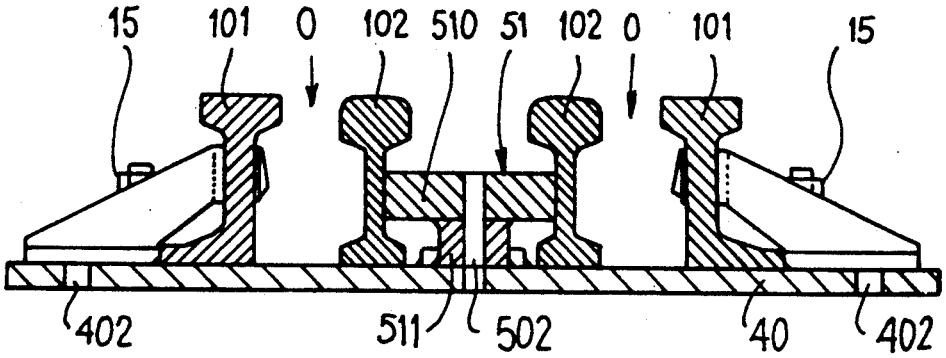
Figure 2E:
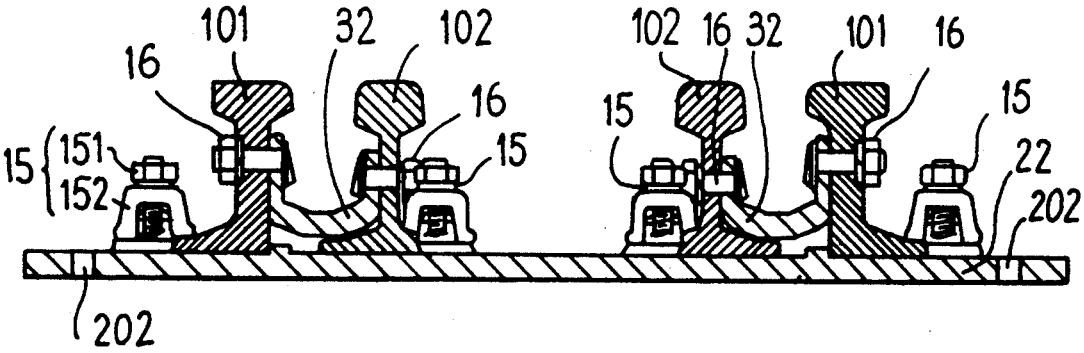
Figure 3:
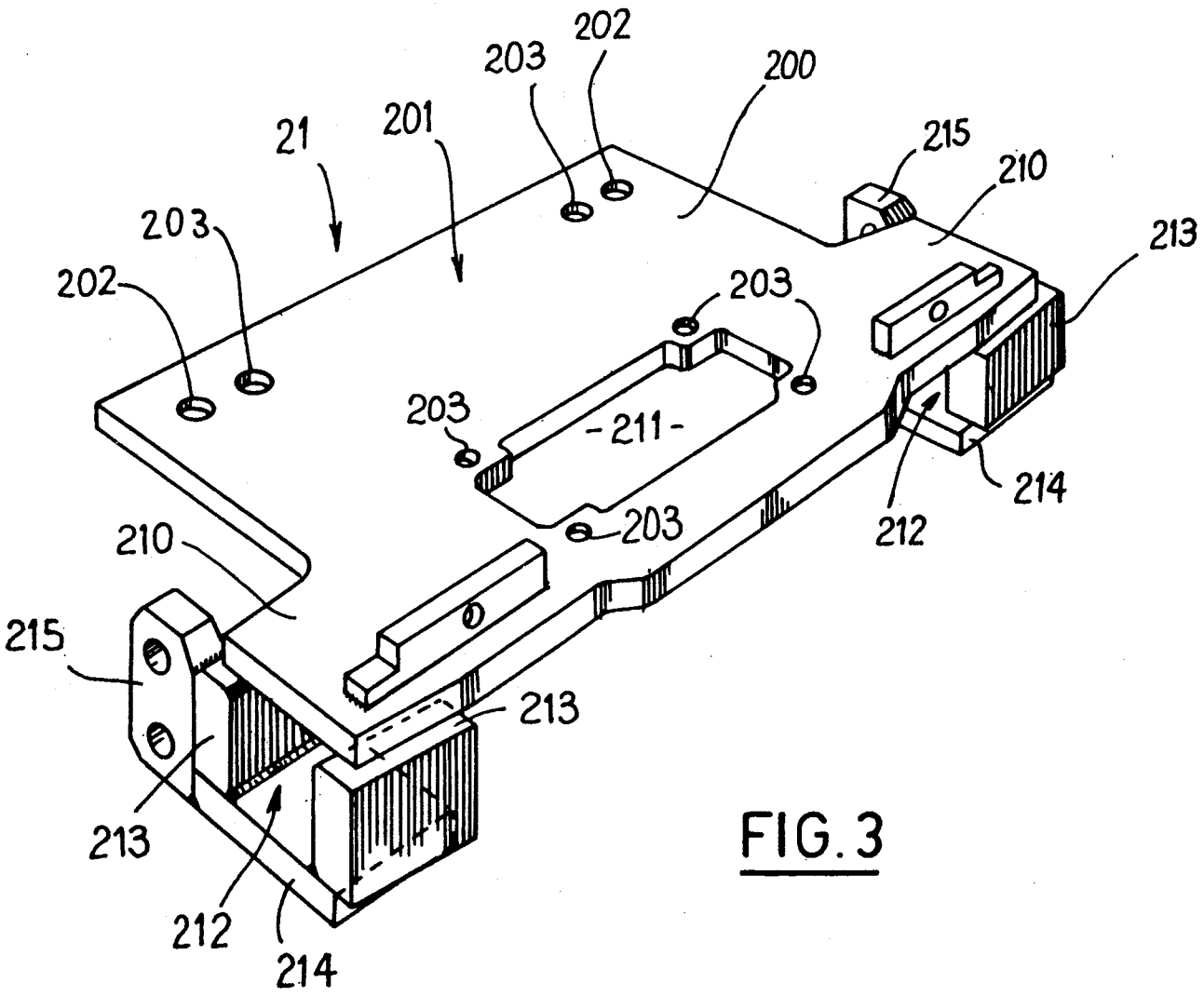
FIG. 3 is a detailed view of a single end plate for a point.
Figure 4:
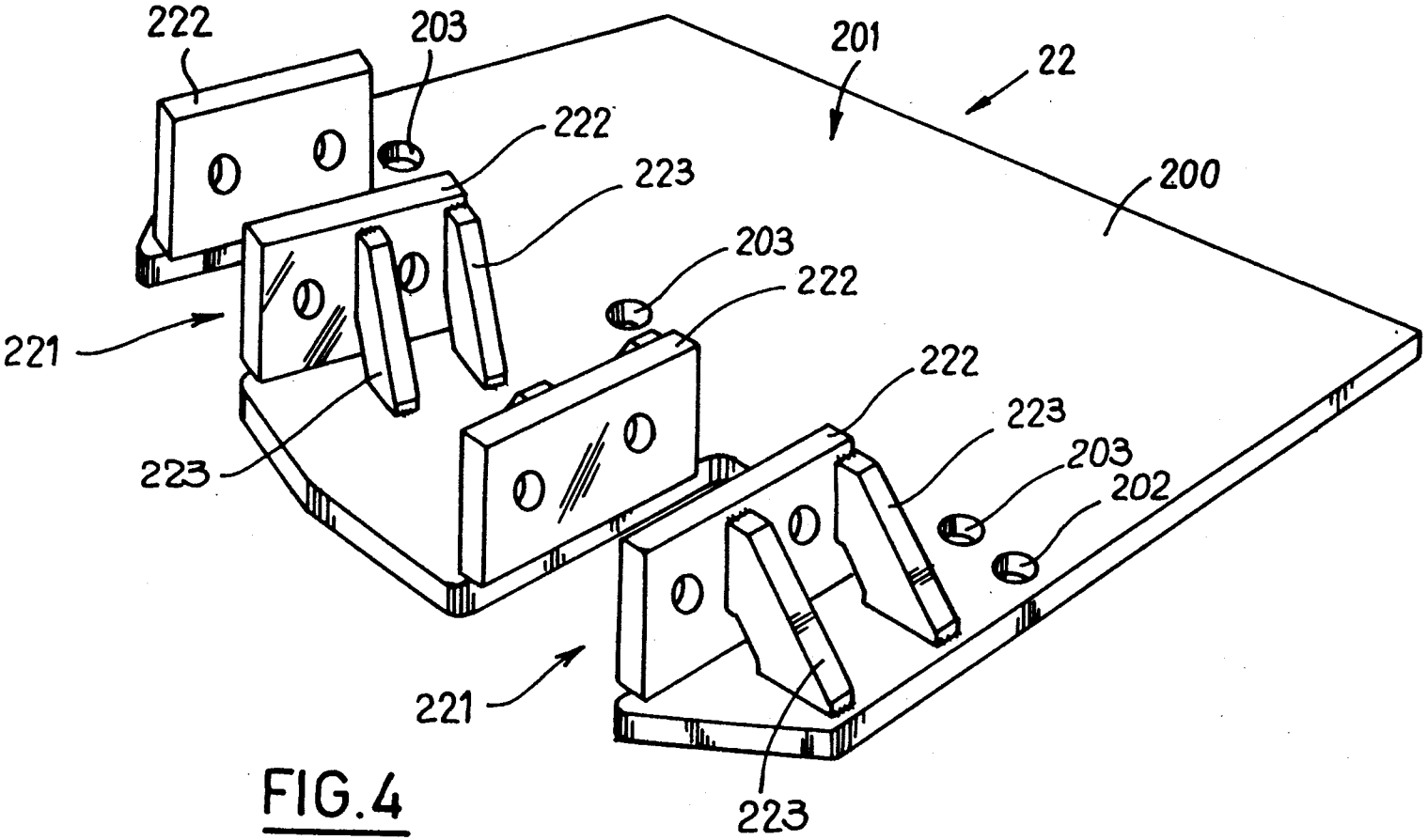
FIG. 4 is a detailed view of a double end plate for a heel.

The plates 20 include a single point end plate 21 which is mechanically assembled for example by means of HUCK bolts or mechanically welded so as to support the stock rails 101 at ends thereof adjacent the principle route P. As can be seen in FIGS. 2B and 3, the single point end plate 21 comprises a base 200, which is approximately rectangular, with a face 201 intended to support the stock rails 101.

Base 200 possesses on two of its opposite sides which are parallel to the track transversely aligned extensions 210. Base 200 is provided with an opening 211 which traverses the base and which is arranged in the axis of the extensions 210 for the passage of an engagement lug 172 of a rod 171 of the control, interlocking and immobilization system 17 for the points of switchblades 102. On its face opposite the face 201, the base is equipped, in the zone of the two extensions 210, with U-shaped tunnels each formed by two lateral projections or cheeks 213, extending perpendicular to the faces of the base, and by a floor 214 approximately parallel to the faces and joining the cheeks 213 for the passage of the rod 171 of the control, interlocking and immobilization system 17. A support 215 makes it possible, if necessary, to fix system 17. By virtue of the virtually symmetrical construction which appears on examination of the drawings, it is possible to provide the control from either side of the track. The base 200 is also traversed by holes 202 intended to receive the fixing means, such as coach screws or the like, and by holes 203 for the assembly means 15.

The latter base, cheeks and floors are made of steel and are joined to one another by welding, for example.

The plates 20 also include a double heel end plate for a which is mechanically assembled for example by means of HUCK bolts or mechanically welded so as to support heel ends of each of two stock rail 101/switchblade 102 heel pairs of each of the direct D and deviated d routes. This double heel end plate 22 comprises a base 200, which is approximately trapezoidal, and whose face 201 is intended to support heel ends of stock rails 101 and switchblades 102.

As can be found by examining the figures of the drawings, two open cutouts 221 are provided in base 200 and are placed in the vicinity of the oblique sides of the trapezium thereof and are oriented parallel to such sides. The base 200 carries on its face 201, on each of the edges of the cutouts 221 parallel to the oblique sides of the trapezium, wings 222, which are parallel to the respective sides, and reinforcements 223, which are perpendicular to the respective sides and extend therefrom to the respective wings 222. This base is also traversed by holes 202, preferably in proximity to the wings 222, in order to receive means for fixing the plate to sleepers.

The latter base, wings and reinforcements are made of steel and are joined to one another, preferably by welding.

The spacers 30, whether a point end spacer 31 or heel end spacers 32, are configured as U-shaped elongate beams. As can be seen by examining the figures of the drawings, these spacers comprise a curvilinear bridge 301 which connects two parallel branches 302.

These branches are traversed by drill holes, preferably bevelled on the inside, and intended to receive mounting means 16 such as screws 304 having a prismatic non-circular head, and nuts. The bevel makes it possible to accommodate screwheads in a conventional manner.

As can be seen, the point end spacer 31 is mounted on the stock rails 101, whereas each of the heel spacers 32 is mounted on a respective stock rail 101 and an adjacent respective switchblade 102. As can be seen, the heel end spacers 32 are asymmetrical and possess unequal parallel branches whereas, preferably, the point spacer 31 is symmetrical and possesses equal parallel branches.

According to the invention, the point end spacer 31 and the heel end spacers 32 are preferably made of cast iron or steel.

The sole plates 40 are made of substantially rectangular sheets 41, one of the faces 401 of which is intended to support the stock rails 101 and the switchblades 102. These sheets are traversed by holes 402, preferably in the vicinity of their small opposite sides, in order to receive the means for fixing to the sleepers. As can be observed, especially in FIG. 1, the length of the large opposite sides of the sheets increases from one sole plate to the other, from the point end to the heel end of the switch.

Preferably, the sole plates are made of steel.

The stops 50 comprise inner stops 51 and outer stops 52.

The inner stops 51 are arranged between the two switchblades 102 and preferably have the configuration of a T-shaped beam in section with a trapezoidal plate or table 510 and a parallelepipedal support 511. The latter table and support are traversed by a hole 502 in order to receive the means for fixing to the sleepers. As can be seen, the length of the parallel bases of the trapezoidal table 510 increases from one inner stop to the other, from the point end to the heel end of the switch.

The table and support of the inner stops are made of steel and are joined to each other, preferably by welding.

The outer stops 52 preferably have the configuration of cylindrical studs which are pierced axially by a blind bore 503, preferably threaded, in order to receive means for mounting on the stock rails 101. As can be observed, the axial length of the outer stops 52 increases from one stop to the other from the point end to the heel end of the switch.

These outer stops are preferably made of steel.

In order to manufacture the plates, the sole plates and the stops and the spacers, use is preferably made of E 24-2, A 50 and E 26-1 steels.

The rails 10 of which the stock rails 101 and the switchblades 102 are made are, for example, conventional VIGNOLES rails made of carbon steel.

The constituents which have been described above are combined, as illustrated diagrammatically in FIG. 1, so as to produce a switch according to the invention.

Firstly, the stock rails 101 are placed on an assembly table and are joined together by means of the point end spacer 31 and the double heel end plate 22. The procedure is preferably followed in this order since this permits the accurate positioning, at the point end and at the heel end, of the curved stock rail 101 relative to the rectilinear stock rail 101. The radius, along its length, of the curved stock rail 101 is determined by positioning the sole plates 40 which permit the ordinates of the curve to be obtained to be fixed with precision. Then, the single point end plate 21 is put in place, which plate has the essential function of providing one of the ordinates of the stock rails 101, on the one hand, and, on the other hand, of supporting, if appropriate, the control, interlocking and immobilization system of the switchblades which may differ from one switch to the other.

The points of the switchblades 102 are brought together, preferably with interposition of a buffer made of a material which facilitates the relative sliding of the two switchblades against each other during their flexion, so as to reduce the maneuvering force to be applied in order to change direction. These buffers are, for example, made of polyamide or polyethylene.

The switchblades 102 thus brought together are placed between the stock rails 101 and are fixed on the double heel end plate 22. To achieve this, on the one hand the heel end spacers 32 which make it possible to combine the heels of each stock rail and switchblade pair are used. In this way, it is possible for the spacing between the flanks of the heads which define the guide groove to be fixed with great accuracy. When this has been done, the heel end inner stops 51 are then fixed and then the point end outer stops 52 are put in place.

The switch according to the invention is particularly suitable for tracks for automatic vehicles for the transport of persons.

From the above, it is easy to understand the full value of a switch according to the invention which is obtained from an absolute minimum number of constituents which are essentially joined by mechanical assembly or mechanical welding. This makes it possible in particular to eliminate the preparatory period for mold manufacture and the period for carrying out the casting while at the same time allowing notable gains in terms of mass and size.

I claim:

1. A switch for a grooved guide track including principle route, a direct route and a deviated route, each including a groove defined between facing flanks of a pair of spaced rails and for receipt of a roller of a vehicle to guide the direction of travel of the vehicle, said switch being operable to selectively align the principle route of the guide track with either of the direct or deviated routes thereof, said switch comprising:

two fixed stock rails having first ends to be aligned with the spaced rails of the principle route and second ends to be aligned with respective rails of the direct route and the deviated route;

two partially movable switchblades positioned between said two stock rails and having respective heel ends to be fixed in alignment with respective rails of the direct route and the deviated route and respective point ends directed toward said first ends of said two stock rails and capable of simultaneous movement due to flexure of said switchblades toward alternate of said stock rails, thereby defining alternate switch grooves extending from between said first ends of said stock rails to between respective pairs of said second ends of said stock rails and said heel ends of said switchblades;

a single end plate having mounted thereon said first ends of said stock rails for support thereof in a position to be aligned with the spaced rails of the principle route;

a double end plate having mounted thereon said second ends of said stock rails and said heel ends of said switchblades for support of said pairs thereof in respective positions to be aligned with the spaced rails of the direct route and the deviated route;

respective spacers mounted between said first ends of said stock rails and between said second end of said stock rail and said heel end of said switchblade of each of said pairs thereof for maintaining spacings therebetween to ensure that said switch grooves correspond to the grooves of the principle, direct and deviated routes;

sole plates for supporting said stock rails and said switchblades at positions thereof other than said single and double end plates;

at least one inner stop mounted on a said sole plate and positioned between said switchblades adjacent said heel ends thereof;

outer stops mounted on respective said stock rails at positions to be abutted by said switchblades adjacent said point ends thereof; and said two stock rails, said two switchblades, said single end plate, said double end plate, said spacers, said sole plates, said at least one inner stop and said outer stops comprising separately produced and formed elements assembled together in operative relationship.

2. A switch as claimed in claim 1, wherein said separately formed and produced elements are at least partially assembled by mechanical means.

3. A switch as claimed in claim 1, wherein said separately formed and produced elements are at least partially assembled by welding.

4. A switch as claimed in claim 1, wherein said first ends of said stock rails are supported directly on said single end plate.

5. A switch as claimed in claim 1, wherein said single end plate comprises an approximately rectangular base member having an upper surface on which are mounted said stock rails, a lower surface, opposite sides extending parallel to said stock rails, aligned extensions extending laterally outwardly from said sides, an opening aligned with said extensions, a U-shaped tunnel extending downwardly from said lower surface of each said extension, each said tunnel including a pair of vertical members extending downwardly from said lower surface and transverse to said sides and a horizontal member extending between and joining said pair of vertical members, and holes adjacent said sides for the passage of means for mounting said base member to a sleeper.

6. A switch as claimed in claim 5, further comprising a control, interlocking and immobilization system for moving said point ends of said switchblades, said system comprising a rod extending through said tunnels and a lug connected to said rod and extending upwardly therefrom through said opening and mounted to at least one of said switchblades adjacent said point end thereof.

7. A switch as claimed in claim 5, wherein said base member, said vertical members and said horizontal members are formed of steel.

8. A switch as claimed in claim 1, wherein said second ends of said stock rails and said heel ends of said switchblades are supported directly on said double end plate.

9. A switch as claimed in claim 1, wherein said double end plate comprises an approximately trapezoidal base member having an upper surface on which are mounted said second ends of said stock rails and said heel ends of said switchblades, opposite oblique sides, two openings oriented parallel to respective said sides, wing members mounted on said upper surface adjacent edges of respective said openings and extending parallel to respective said sides, reinforcement members extending from respective said sides perpendicular thereto to respective said wing members, and holes adjacent said sides for the passage of means for mounting said base member to a sleeper.

10. A switch as claimed in claim 9, wherein said base member, said wing members and said reinforcement members are formed of steel.

11. A switch as claimed in claim 1, wherein each said spacer comprises an elongated beam having a U-shaped transverse configuration defined by two spaced parallel branches joined by a curvilinear bridge.

12. A switch as claimed in claim 11, wherein said branches have therethrough holes for receiving mounting means.

13. A switch as claimed in claim 11, wherein said branches of said spacer for said first ends of said stock rails are of equal height.

14. A switch as claimed in claim 11, wherein said branches of said spacers for each said pair of said second end of the respective said stock rail and said heel end of the respective said switchblade are of unequal height.

15. A switch as claimed in claim 1, wherein said spacers are formed of steel.

16. A switch as claimed in claim 1, wherein each said sole plate comprises an approximately rectangular plate member having an upper surface on which are mounted said stock rails or said stock rails and said switchblades, spaced larger sides extending transverse to said stock rails, spaced smaller sides extending parallel to said stock rails, and holes adjacent said smaller sides for the passage of means for mounting said plate member to a sleeper.

17. A switch as claimed in claim 16, wherein the length of said larger sides of said plate members increases from one sole plate to another in a direction from said first ends to said second ends of said stock rails.

18. A switch as claimed in claim 16, wherein said plate members are formed of steel.

19. A switch as claimed in claim 1, wherein said inner stop is T-shaped and includes a trapezoidal upper member supported on a parallelepipedal base member mounted on said sole plate, and having therethrough a hole for the passage of means for mounting to a sleeper.

20. A switch as claimed in claim 19, comprising a plurality of said inner stops mounted on respective said sole plates, said inner stops each having a length dimension substantially transverse to said switchblades, said length increasing from one inner stop to another in a direction toward said heel ends of said switchblades.

21. A switch as claimed in claim 19, wherein said upper member and said base member are formed of steel.

22. A switch as claimed in claim 1, wherein each said outer stop comprises a cylindrical member having therethrough an axial bore for passage of means for mounting said member to a respective said stock rail.

23. A switch as claimed in claim 22, wherein said cylindrical members of said outer stops have axial lengths increasing from one outer stop to another in a direction from said point ends of said switchblades to said heel ends thereof.

* * * * *